United States Patent [19]

Takahashi et al.

[11] Patent Number: 4,879,269

[45] Date of Patent: Nov. 7, 1989

[54] PRESSURE SENSITIVE COPY MATERIAL

[75] Inventors: Naoya Takahashi, Yokohama; Satoshi Narui, Ayase; Eiichi Matsuzaka, Kawasaki, all of Japan

[73] Assignee: Nippon Petrochemicals Co., Ltd., Japan

[21] Appl. No.: 333,791

[22] Filed: Apr. 3, 1989

Related U.S. Application Data

[63] Continuation of Ser. No. 946,535, Dec. 24, 1986, abandoned.

[30] Foreign Application Priority Data

Dec. 26, 1985 [JP] Japan ..... 60-297156

[51] Int. Cl.[4] ..... B41M 5/16; B41M 5/22

[52] U.S. Cl. ..... 503/213; 427/150; 428/914

[58] Field of Search ..... 427/150–152; 428/914; 503/213

[56] References Cited

U.S. PATENT DOCUMENTS

| | | | |
|---|---|---|---|
| Re. 32,162 | 5/1986 | Sato et al. | 346/213 |
| 3,996,405 | 12/1976 | Porter | 427/150 |
| 4,390,194 | 6/1983 | Sato | 427/150 |

*Primary Examiner*—Bruce H. Hess

*Attorney, Agent, or Firm*—Ostrolenk, Faber, Gerb & Soffen

[57] ABSTRACT

The present invention provides a pressure sensitive copy material using an electron accepting developer and an electron donating coupler which develops a color by contacting with the developer, the pressure sensitive copy material being characterized by employing phenyl-sec-butylphenyl-methane as a solvent for the electron donating coupler.

8 Claims, No Drawings

PRESSURE SENSITIVE COPY MATERIAL

This is a continuation of application Ser. No. 946,535 filed on Dec. 24, 1986, now abandoned.

BACKGROUND OF THE INVENTION (1) Field of the Invention

The present invention relates to a record material, more particularly to a pressure sensitive copy material.

(2) Description of the Prior Art

Heretofore, record materials, i.e., pressure sensitive copy papers have been known which are composed of a paper coated on the one side thereof with microcapsules containing a colorless electron donating agent (hereinafter referred to as the coupler) in a liquid state therein and another paper coated on the one side thereof with an electron accepting substance (hereinafter referred to as the developer) such as a clay or a polymeric material having an ability to develop a color by the reaction with the aforesaid coupler. When used, both the papers are superposed on each other so that the respective coated surfaces thereof may face each other, and pressure is then applied onto the superposed papers, so that a copy record is given thereby.

This type of record material has the following copy record mechanism: The microcapsules on the paper are ruptured by the pressure from a pen, a typewriter or the like in order to release a coupler solution therefrom, and the latter is then brought into contact with the developer with which the confronted paper has been coated, whereby a color is developed.

Further, another type of record material has been known in which the respective coating layers having such a color developing mechanism as described above are formed onto either surface of one paper, the microcapsule layer and the developer layer being disposed as an inside layer and an outside layer, respectively. In the case of this record material, the microcapsules, when used, are broken by a pressure from a pen, a typewriter or the like to consequently release a coupler solution therefrom, and the latter then contacts with the developer of the outside layer, thereby developing a color.

The coupler solution used in the aforesaid record material is a solution in which the electron donating coupler is dissolved in one or more hydrophobic solvents. The hydrophobic solvent used therein is required to satisfy the following requirements.

That is, these requirements are to be nontoxic; to have no uncomfortable odor; to be colorless or to have an extremely faint color; to be nonvolatile; to dissolve the coupler sufficiently; to be excellent in stability, after having dissolved the coupler; to be able to change into minute dispersions, when microcapsuled; to permit encapsulating the minute dispersions; to ensure a storage stability of the microcapsules; to permit coating a sheet material with the microcapsules uniformly with a suitable thickness; to allow a color developing reaction to occur, when the coupler contacts with the developer, and to accelerate a color development velocity; when a paper is coated a polymeric material which is the developer, to dissolve the polymeric material so as to enable a close contact with the coupler; to permit providing sharp color-developed images without blotting; and even after stored for a long period of time, to ensure the formation of the clear color-developed images.

Examples of the already known and industrially used solvents for the coupler in this kind of pressure sensitive copy material include diarylalkanes such as phenylxylyl-ethane, phenyl-isopropylphenylethane, phenylxylyl-methane; an alkylnaphthalene such as diisopropylnaphthalene; an alkylbiphenyl such as isopropylbiphenyl; and partially hydrogenated terphenyl.

In addition, as the solvents for the coupler, various diarylmethanes and diarylethanes have been suggested in U.S. Pat. No. 3,836,383, Japanese Patent Provisional Publication No. 15,613/1973 and U.K. Pat. No. 1,389,674. However, these suggested solvents do not satisfy the above mentioned requirements for the solvent, in particular, the requirements of the color development properties and the inhibition of an odor simultaneously.

Generally speaking, the solvent having a high color development velocity also has a low boiling point and strong odor. Inversely, a solvent having less odor has high boiling point and viscosity, and is poor in color development properties.

SUMMARY OF THE INVENTION

The present invention intends to provide a pressure sensitive copy material which can solve the above mentioned problems of the conventional solvent for a coupler and which has an excellent color development performance and less odor.

The inventors of the present application have conducted researches on structures of alkylene and alkyl groups of various diarylalkanes, their physical properties, and relations between these factors and performance in the case that they are used as the solvents for the coupler in the pressure sensitive copy material. As a result, it has been found that the color development performance is higher when the alkylene group is a methylene group than when it is an ethylidene group or an ethylene group, and that the higher the color development performance, the smaller the number of substituted alkyl groups on a benzene ring and the lower the branching coefficient of the alkyl group. In consequence, the present invention has now been completed on the basis of this knowledge.

Moreover, the present inventors have also found that among the $C_4$ alkyl groups, a sec-butyl group is suitable.

That is, the present invention intends to provide a solvent used in the pressure sensitive copy material which is excellent in color development intensity and color development velocity and which can be manufactured at a low cost.

The present invention is directed to a pressure sensitive copy material using an electron accepting developer and an electron donating coupler which develops a color by contacting with the developer, the pressure sensitive copy material being characterized by employing phenyl-sec-butylphenyl-methane as a solvent for the electron donating coupler which develops the color by contacting with the electron accepting developer.

DESCRIPTION OF THE PREFERRED EMBODIMENT

Phenyl-sec-butylphenyl-methane can be prepared by any known method. For example, there is the method of alkylating diphenylmethane by the use of normal butene in the presence of an acid catalyst, the method of benzylating sec-butylbenzene likewise with the aid of an acid catalyst, a method of condensing benzene and sec-butylbenzene with formalin, and the like. However, the present invention should not be limited to these methods.

The above mentioned phenyl-sec-butylphenyl-methane can be manufactured more inexpensively than, for example, phenyl-n-butylphenyl-methane or the like.

Phenyl-sec-butylphenyl-methane has three position isomers of ortho-, meta- and para-compounds owing to substitution positions of the sec-butyl group, and all of these isomers can be used in the present invention. Nevertheless, the solvent containing the meta-isomer, the para-isomer or a mixture thereof is desirable from the viewpoints of a color development performance and the like, and the total amount of the meta- and para-isomers in the solvent is preferably 50% by weight or more, more preferably 60% by weight or more. Such a suitable solvent can be easily prepared by altering reaction conditions in the above mentioned manufacturing methods.

The solvent of the present invention can be used, of course, alone and insofar as the properties of the solvent itself are not impaired, together with an auxiliary solvent such as a kerosene fraction, an isoparaffinic solvent, a normal paraffinic solvent, a naphthenic solvent or an alkylbenzene.

In addition thereto, a solvent prepared by mixing the phenyl-sec-butylphenyl-methane with another known solvent for a coupler can also be employed in the present invention.

As colorless or nearly colorless electron donating couplers which can develop a color by contacting with a developer, they are typically triarylmethane type compounds, diphenylmethane type compounds, xanthene type compounds, thiazine type compounds, and spiropyran type compounds.

The dye-precursors of triarylmethane type compounds are exemplified by 3,3-bis(p-dimethylaminophenyl)-6-dimethylaminophthalide (Crystal Violet Lactone), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3-(p-dimethylaminophenyl)-3-(2-phenylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-5-dimethylaminophthalide, 3,3-bis(2-phenylindole-3-yl)-5-dimethylaminophthalide, and 3-p-dimethylaminophenyl-3-(1-methylphrrole-2-yl)-6-dimethylaminophthalide.

The dye-precursors of diphenylmethane type compounds are exemplified by 4,4-bis-dimethylaminobenzhydrine benzyl ether, N-halophenyl leuco Auramine, and N-2,4,5-trichlorophenyl leuco Auramine.

The xanthene type dye-precursors are exemplified by Rhodamine B-anilinolactam, Rhodamine B-(p-nitroanilino)lactam, Rhodamine B-(p-chloroanilino)lactam, 3-dimethylamino-6-methoxyfluoran, 3-diethylamino-7-methoxyfluoran, 3-diethylamino-7-chloro-6-methylfluoran, 3-diethylamino-7-(acetylmethylamino)fluoran, 3-diethylamino-7-(dibenzylamino)-fluoran, 3-diethylamino-7-(methylbenzylamino)fluoran, 3-diethylamino-7-(chloroethylmethylamino)fluoran, 3-diethylamino-7-(diethylamino)fluoran, and 3-diethylamino-6-methyl-7-anilinofluran.

The thiazine type dye-precursors are exemplified by benzoyl leuco methylene blue and p-nitorbenzoyl leuco methylene blue.

The spiro type dye-precursors are exemplified by 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)spiropyran, and 3-propyl-spiro-dibenzodipyran.

The coupler can be dissolved into the solvent of the invention in the manner likewise used with conventional solvents.

As electron accepting color developers, there are clay, polymers, and aromatic carboxylic acids or their metal salts.

The polymers are exemplified by phenol-aldehyde polymer, phenol-acetylene polymer, maleic acid-rosin polymer, partially or completely hydrolyzed styrene-maleic anhydride copolymer, partially or completely hydrolyzed ethylene-maleic anhydride copolymer, carboxy polyethylene, and partially or completely hydrolyzed vinyl methyl ether-maleic anhydride copolymer.

The examples of aromatic carboxylic acids and their derivatives are exemplified by 3,5-di(α-methylbenzyl)-salicylic acid, 3-(α-methylbenzyl)-5-(α,α-dimethylbenzyl)salicylic acid, 3-(4'-α',α'-dimethylbenzyl)phenyl-5-(α,α-dimethylbenzyl)salicylic acid, 3,5-di-tert-butyl salicylic acid, 3,5-di-tert-octyl salicylic acid, 3-cyclohexyl-5-(α,α-dimethylbenzyl)salicylic acid, 3-phenyl-5-(α,α-dimethylbenzyl)salicylic acid and 3,5-di(α,α-dimethylbenzyl)salicylic acid. Furthermore, their salts of polyvalent metals such as zinc, aluminum, barium, tin, iron, calcium and lead can also be used.

In addition, as the electron accepting developers, there are exemplified by bentonite, zinc oxide, tatanium oxide, kaolin, active china clay, acidic china clay, zeolite, talc and colloidal silica.

The above mentioned coupler, when used, is dissolved in a solvent of the present invention, but the amount of the dissoled coupler is generally within the range of 0.5 to 15% by weight or so.

As the copy material of the present invention, a pressure sensitive copy material, for example, a pressure senstive copy paper is now prepared, and its generic manufacturing method will be described: A solution in which the aforesaid coupler is dissolved in the solvent of the present invention is emulsified and dispersed in a mixed aqueous solution of gelatin and gum arabic, and gelatin coatings are then formed around emulsified oil drops by means of the coacervation method. In recent years, an interfacial polymerization, an in-situ polymerization and the like can often be employed for the formation of resin coatings. A first paper is then coated with the thus formed capsule emulsion of the fine oil drops. Afterward, a second paper is coated on its surface which will confront the above coated surface of the first paper with the aforesaid developer, or alternatively the above mentioned first paper is further coated, on the already coupler-coated surface thereof, with the aforesaid developer in the form of a layer, so that the desired pressure sensitive copy paper can be manufactured.

EXAMPLE

By the use of a cation exchange resin (Amberlist-15; Rhoom & Haas Co., Ltd.), diphenylmethane was allowed to react with normal butene in order to prepare phenyl-sec-butylphenyl-methane.

This product had a boiling point of 301° to 312° C. and a kinematic viscosity of 3.9 c.s. at 40° C. The total content of meta- and para-isomers in the product was about 80% by weight. In this solvent, CVL which was a coupler was dissolved in as much as an amount of 5% to obtain a coupler solution.

This solution was then changed into microcapsules in accordance with the complex coacervation method using gelatin. With the thus obtained microcapsule emulsion, a fine paper was coated to prepare an upper paper.

On the other hand, another paper was coated with a phenolic resin which was a developer, in order to prepare a lower paper.

The prepared upper and lower papers were superposed on each other so that the microcapsule coated surface of the upper paper might face the developer coated surface of the lower paper, and a high pressure press was then driven to develop a color all over the surface.

The lower paper was measured for its reflectance at room temperature by the use of a reflection type spectrophotometer 30 seconds, 60 seconds and 60 minutes after the press operation, in order to thereby obtain color development intensities.

The results are set forth in Table 1. Additionally, the judgment results of odors are listed together.

Each odor judgment result represents the total points awarded by 10 judges on the basis of the standard of "a strong bad odor" being −1 point, "a bad but allowable odor" being 0 point and "no bad odor" being 1 point.

For comparison, as diarylethanes having the same carbon number as in the above Example regarding the present invention, there were used 1-phenyl-1-(isopropylphenyl)ethane (solvent A), 1-phenyl-2-(isopropylphenyl)ethane (solvent B) and phenyl-tert-butylphenyl-methane (solvent C), and the results are set forth in columns of Comparative Examples 1 to 3 in Table 1. It is apparent from the results therein that the Comparative Examples all had poorer color development properties than in the Example regarding the present invention.

Further, Comparative Examples 4 to 7 were concerned with bicyclic aromatic hydrocarbon solvents having a less carbon atom number than in the Example of the present case.

Solvent D was phenyl-xylylethane, solvent E was phenyl(ethylphenyl)ethane, solvent F was benzyl-ethylbenzene and solvent G was diisopropylnaphthalene.

The solvents E and F were excellent in color development properties, but were poor in odor inhibition. The solvent D had poorer color development properties than in the above Example. The solvent G was excellent in odor inhibition but poor in color development properties. In short, the solvents used in the present invention have better color development properties and odor inhibition, as compared with the conventionally used solvents in the Comparative Examples. Comparing with the solvents of Comparative Examples 1, 2, 3, 4 and 7, the excellent color development properties which the solvents of the present invention have are more remarkable at temperatures lower than room temperature.

TABLE 1

| | Solvent | Color Devel. Intensity (%) After 30 sec | After 60 sec | After 60 min | Color Devel. Velocity Ratio(%) | Odor |
|---|---|---|---|---|---|---|
| Example | | Better | Better | Better | Better | 8 |
| Comparative Example | | | | | | |
| 1 | A | Good | Good | Better | Good | 6 |
| 2 | B | Good | Better | Better | Good | 8 |
| 3 | C | Good | Better | Better | Good | 7 |
| 4 | D | Good | Better | Better | Good | 6 |
| 5 | E | Better | Better | Better | Better | 5 |
| 6 | F | Better | Better | Better | Better | 3 |
| 7 | G | Middle | Good | Better | Middle | 8 |

STANDARD OF JUDGMENT:

In the heading "Color Development Intensity" in Table 1, the respective indications have the following meanings:

"Better"=the intensity being 66% or more

"Good"=the intensity being from 61 to 65%

"Middle"=the intensity being 60% or less

Each color development intensity was obtained as follows: The lower paper was measured for a reflectance before and after the color development, and the color development intensity was then calculated from the measured reflectance in accordance with the following formula:

$$\text{Color development intensity } (\%) = (I - I_0)/I_0 \times 100$$

wherein $I_0$ and I represent reflectances of the lower paper before and after the color development, respectively.

Therefore, the greater the value obtained from the above formula the better the color development intensity.

In the heading "Color Development Velocity Ratio" in Table 1, the respective indications have the following meanings:

"Better"=the velocity ratio being 96% or more

"Good"=the velocity ratio being from 91 to 95%

"Middle"=the velocity ratio being 90% or less

The color development velocity ratio was a ratio (%) of the color development intensity after 30 seconds to the intensity after 60 minutes in the heading "Color Development Intensity" in Table 1. Therefore, it is meant that the greater this ratio (%), the higher the color development velocity is.

The pressure sensitive copy material of the present invention in which phenyl-sec-butyl-phenyl-methane is used as the solvent for the coupler is characteristically excellent in color development properties and the odor inhibitions in good balance, as compared with the cases where conventionally known other solvents are used such as phenyl-xylyl-ethane, phenyl-isopropylphenylethane, diisopropylnaphthalene and phenyl-xylylmethane. Further, it is also beneficial that the solvent of the present invention can be prepared at a low cost by a usual alkylation.

Furthermore, comparing with the case where the compound having a $C_4$ alkyl group, for example, phenyl-tert-butylphenyl-methane is employed as the solvent, the product of the present invention is better.

What is claimed is:

1. A pressure sensitive copy material using an electron accepting developer and an electron donating coupler which develops a color by contacting with said developer, said pressure sensitive copy material being characterized by employing phenyl-sec-butylphenylmethane as a solvent for said electron donating coupler, wherein at least 60% of the phenyl-sec-butylphenylmethane is the meta- or para-isomer or a mixture thereof.

2. A pressure sensitive copy material according to claim 1 wherein said pressure sensitive copy material is a copy paper.

3. A pressure sensitive copy material according to claim 1 wherein at least 80% is the meta- or para- isomers or a mixture thereof.

4. A pressure sensitive copy material according to claim 3 wherein said pressure sensitive copy material is a copy paper.

5. A pressure sensitive copy material comprising a substrate having an electron donating coupler thereon, said electron donating coupler developing color by contact with an electron accepting developer, said pressure sensitive copy material being characterized by employing phenyl-sec-butylphenyl-methane as a solvent for said electron donating coupler wherein at least 60% of the phenyl-sec-butylphenyl-methane is the meta- or para-isomer or a mixture thereof.

6. A pressure sensitive copy material according to claim 5 wherein said pressure sensitive copy material is a copy paper.

7. A pressure sensitive copy paper according to claim 5 wherein at least 80% is the meta- or para-isomers or a mixture thereof.

8. A pressure sensitive copy material according to claim 7 wherein said pressure sensitive copy material is a copy paper.

* * * * *